United States Patent [19]

Demler, Jr. et al.

[11] Patent Number: 4,917,616

[45] Date of Patent: Apr. 17, 1990

[54] BACKPLANE SIGNAL CONNECTOR WITH CONTROLLED IMPEDANCE

[75] Inventors: Henry W. Demler, Jr., Lebanon, Pa.; Frank P. Dola, Hudson, Fla.; David J. Kimmel, Clearwater, Fla.; Thomas J. Sotolongo, Clearwater Beach, Fla.

[73] Assignee: AMP Incorporated, Harrisburg, Pa.

[21] Appl. No.: 220,045

[22] Filed: Jul. 15, 1988

[51] Int. Cl.[4] ..... H01R 13/652

[52] U.S. Cl. ..... 439/101; 439/579

[58] Field of Search ..... 439/55, 59–62, 439/79, 80, 83, 92, 101, 108, 607–610, 95, 579; 361/407

[56] References Cited

U.S. PATENT DOCUMENTS

| | | | |
|---|---|---|---|
| 3,470,421 | 9/1969 | Shore et al. | 317/101 |
| 3,533,044 | 10/1970 | Bauman et al. | 339/14 |
| 3,587,028 | 6/1971 | Uberbacker | 439/608 |
| 3,864,000 | 2/1975 | Coller | 339/64 M |
| 3,871,728 | 3/1975 | Goodman | 339/14 R |
| 4,331,370 | 5/1982 | Andrews | 339/17 M |
| 4,451,107 | 5/1984 | Dola | 339/143 R |
| 4,475,781 | 10/1984 | Asick | 339/17 LM |
| 4,601,527 | 7/1986 | Lemke | 339/14 R |
| 4,616,893 | 10/1986 | Feldman | 339/14 R |
| 4,632,476 | 12/1986 | Schell | 339/14 R |
| 4,655,518 | 4/1987 | Johnson | 339/17 LC |
| 4,755,145 | 7/1988 | Johnson | 439/61 |
| 4,762,500 | 8/1988 | Dola | 439/79 |

OTHER PUBLICATIONS

IBM Technical Disclosure Bulletin, vol. 10, No. 3, p. 203, dated Aug. 1967.

Publication entitled "The Electromechanical Design of a Matched Impedance Connector", bu H. H. Blonder & R. T. Evans.

*Primary Examiner*—Neil Abrams

*Attorney, Agent, or Firm*—Robert W. Pitts

[57] ABSTRACT

An electrical connector assembly for use with a motherboard and a daughterboard in a backplane configuration is disclosed. The motherboard connector has an insulative housing with a plurality of signal pins and a plurality of power contacts. A ground bus having upstanding posts is located beween rows of signal pins. A daughterboard signal connector is separate from the daughterboard power, and the daughterboard signal connector has a plurality of ground blades which are matable with the ground bus between adjacent upstanding ground posts. Thus, a substantially constant spacing of signal contacts relative to ground can be maintained through the right angle motherboard/daughterboard connector.

41 Claims, 11 Drawing Sheets

BACKPLANE SIGNAL CONNECTOR WITH CONTROLLED IMPEDANCE

BACKGROUND OF THE INVENTION

1. Field of the Invention

This invention relates to an electrical connector for establishing a signal and power interconnection between orthogonal printed circuit boards.

2. Description of the Prior Art

U.S. Pat. No. 4,655,518 discloses a backplane/daughterboard connector comprising two mating connector halves with mating signal pins and signal receptacles. That connector is intended to provide for the transmission of high frequency electrical signals. Ground contacts are provided adjacent the sidewalls of the housing and adjacent one of the plurality of rows of signal contacts.

The high density controlled impedance connector shown in U.S. patent application Ser. No. 096,792 filed Sept. 11, 1987, a continuation of U.S. patent application Ser. No. 866,518 filed May 23, 1986, now abandoned, discloses another connector for establishing an electrical connection between signal pins in which frequency applications. Unlike the connector shown in U.S. Pat. No. 4,655,518, the connector shown in this last mentioned application provides not only for the interconnection of a plurality of signal contacts without significant changes in impedance, but also provides a means for transmitting power between a motherboard and an orthogonal daughterboard. As the density of contacts in a backplane increases, the problem of delivering adequate power to the printed circuit board also multiplies. That problem is not addressed in U.S. Pat. No. 4,655,518. However, in the previously filed application assigned to the Assignee of the instant application, the controlled impedance for the closely space signals is provided for by use of a cast metal housing which provides a ground plane equally spaced from the individual pins. U.S. Pat. No. 4,655,518, which relies upon a separate ground plane, does not position the ground plane in the same fixed dimensional relationship relative to each of the signal contacts.

The instant invention, like U.S. Pat. No. 4,655,518, uses a separate conductive ground contact in an insulative housing, unlike the cast housing of the previously filed application, commonly assigned. The instant invention provides intermating ground members dispersed between a plurality of signal pins such that the spacing remains substantially the same. The substantially constant signal to ground distance thus results in a connector which is virtually transparent in the sense that signals transmitted through the connector are substantially unaffected.

SUMMARY OF THE INVENTION

The electrical connector assembly comprising the preferred embodiment of this invention is intended for use in impedance controlled interconnections between a motherboard and a daughterboard. In the preferred embodiment of this invention, the connector consists of a motherboard signal connector and an intermating daughterboard signal connector. These signal connectors can be used in conjunction with separate power connectors. Each signal connector has a plurality of signal contacts disposed in two rows. The motherboard signal connector has a ground bus located between the two rows of signal contacts. This ground bus is planar and it mates with a plurality of ground blades in the daughterboard connector. These ground blades are positioned to mate with the planar ground bus in the motherboard signal connector at right angles. These ground blades are disposed in spaced parallel relationship. The ground bus in the motherboard connector has a plurality of upstanding posts spaced apart on a distance equal to twice the spacing of the signal pins when mated. The parallel ground blades in the daughterboard connector are also positioned on a spacing equal to twice the spacing of the mating signal contacts, and the ground blades are staggered relative to the post extending from the motherboard ground bus so that each daughterboard ground blade mates with the motherboard bus between adjacent posts.

BRIEF DESCRIPTION OF THE DRAWINGS

FIG. 3 is a perspective view of the motherboard backplane connector.

FIG. 9 is a section view similar to FIG. 8, but showing the mated configuration of the motherboard backplane connector and the daughterboard signal connector.

FIGS. 11–13 are a series of sectional views illustrating the assembly of the daughterboard signal connector.

FIGS. 11A–13A are taken substantially along section A—A of FIG. 10.

FIGS. 11B–13B are taken substantially along section B—B of FIG. 10, which is parallel to section A—A.

DETAILED DESCRIPTION OF THE PREFERRED EMBODIMENT

Figure 1:
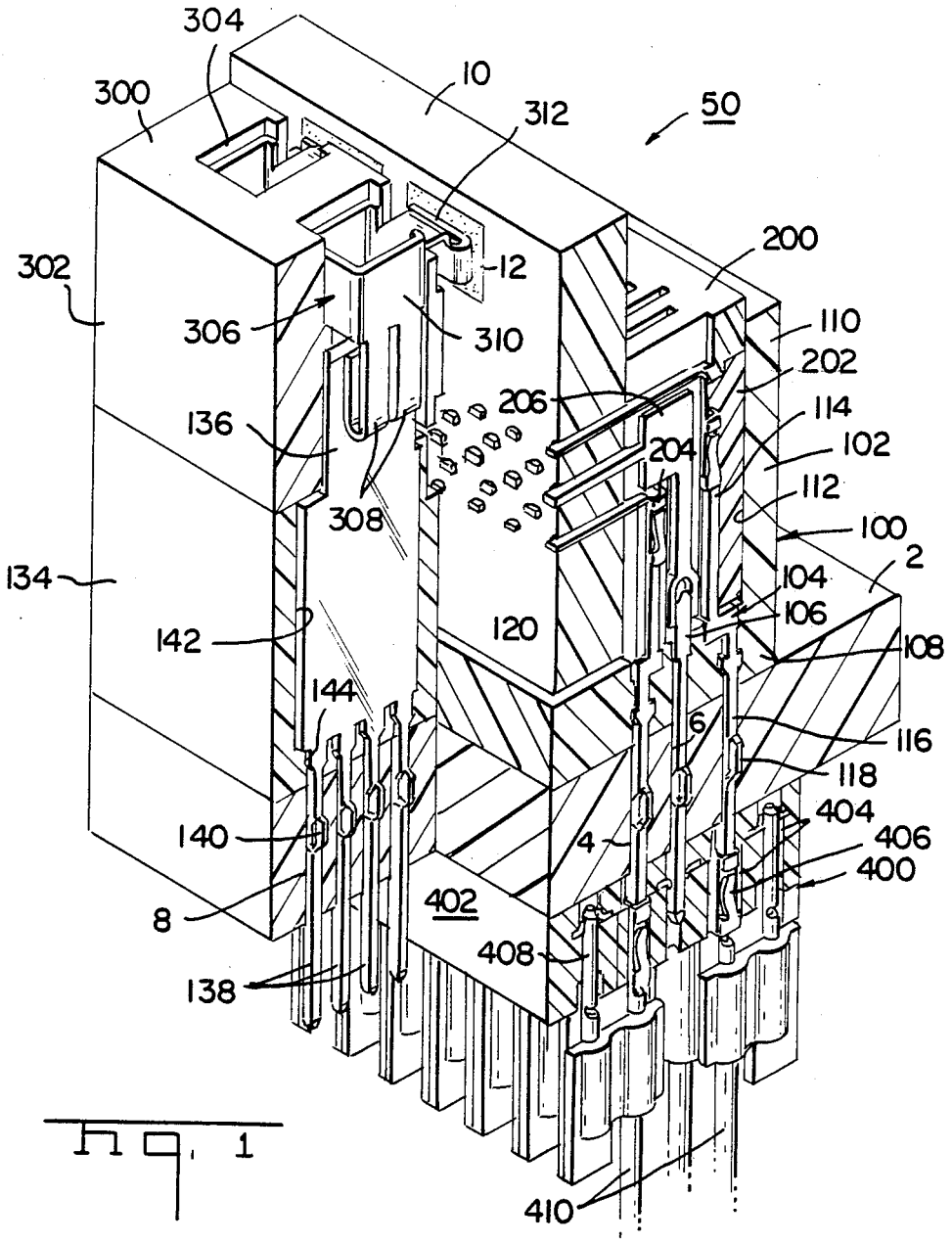
FIG. 1 is a perspective view of one embodiment of a backplane connector assembly including a motherboard backplane connector, a daughterboard signal connector, a daughterboard power connector and a coaxial input connector, all assembled to a motherboard and one daughterboard.

The backplane connector assembly comprising the preferred embodiment of this invention is intended to establish an interconnection between two orthogonal printed circuit boards employed in a backplane assembly used in a computer or similar electronic component. The connector assembly comprising the preferred embodiment of this invention is intended to interconnect both power and signal to both boards. The connector assembly includes a backplane connector assembly 50 consisting of a motherboard backplane connector 100 and daughterboard backplane signal and power, 200 and 300 respectively, connectors for making signal interconnections and for interconnecting power to both the motherboard 2 and to one or more daughterboards 10. This connector assembly is suitable for use with signal contacts spaced apart by a distance of 0.050 inch and can be employed using power contacts intended to deliver 5 amps to both the motherboard 2 and to the daughterboard 10.

A separate connector 400 can be employed to interconnect signal circuit conductors to the motherboard 2 and to the backplane signal connector used on the motherboard. The preferred embodiment of this invention employs a coaxial motherboard signal connector 400. It should be understood, however, that more conventional means of interconnecting signal conductors to the motherboard 2 can also be employed, for example individual signal wires can be soldered or wire-wrapped directly to the pins employed in this assembly. Power is also delivered to both the motherboard 2 and the daughterboard 10 are also employed. In one embodiment, separate power connectors, one a part of the motherboard backplane connector 100 and the other 300 attached to the daughterboard.

Not only will the connector assembly comprising the preferred embodiment of this invention depicted herein deliver both power and signals to a backplance assembly consisting of a motherboard 2 and one or more daughterboards 10, but this connector assembly can also be employed in a manner such that the impedance of the signals transmitted through the connector assembly will match the impedance of the component with which the backplane assembly is used. For example, the preferred embodiment of this invention is intended for use in a backplane connector assembly in which a controlled impedance of 75 ohms is required.

The individual components of this connector assembly will now be described individually in more detail.

Figure 4A:
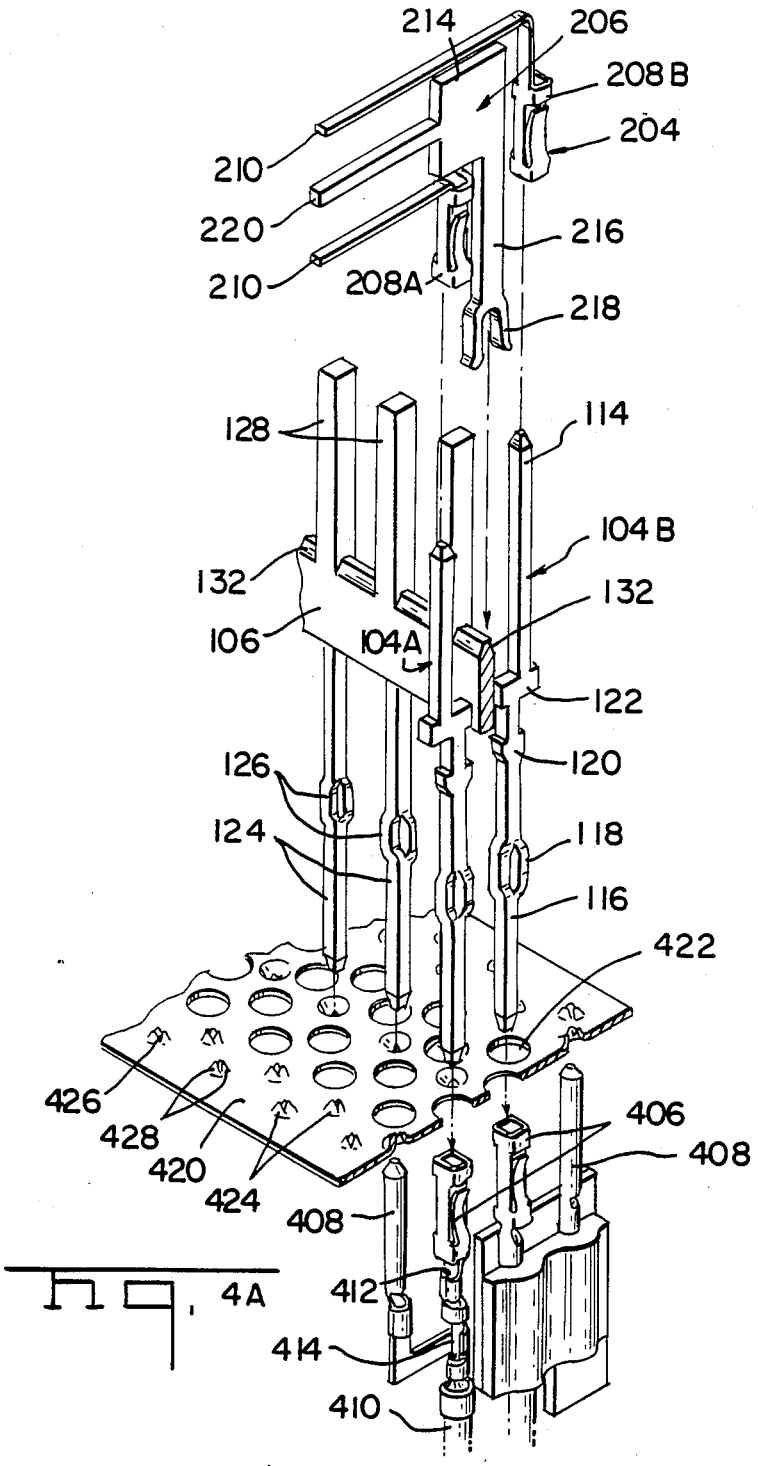
FIGS. 4A and 4B are exploded perspective views showing the motherboard signal and ground contacts and daughterboard contacts at adjacent positions. The coaxial input contacts and the coaxial input connector ground plane are also shown.
Figure 4B:
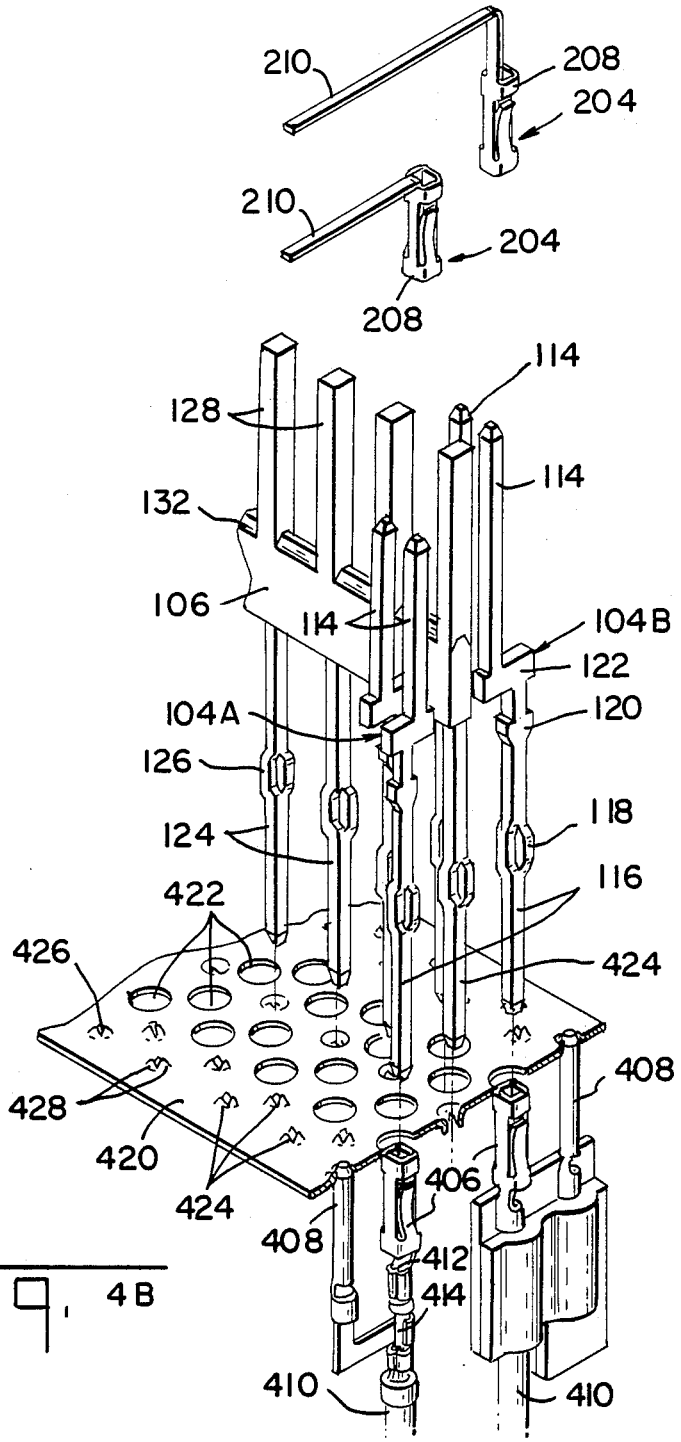
Figure 7:
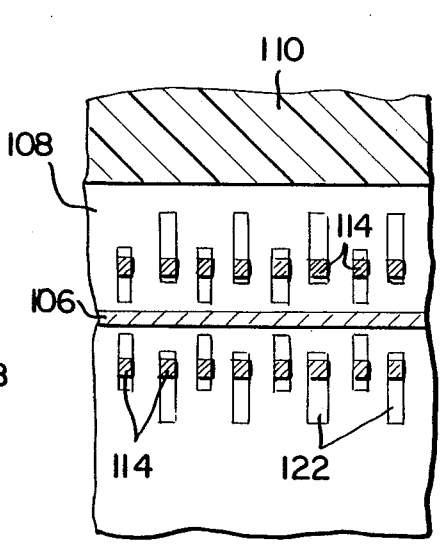
Figure 6:
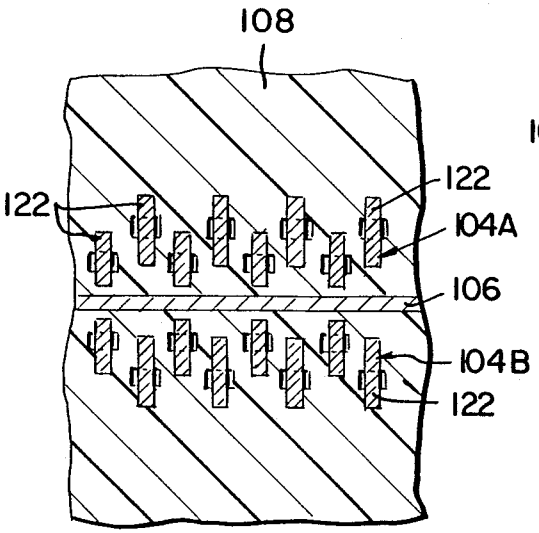
Figure 5:
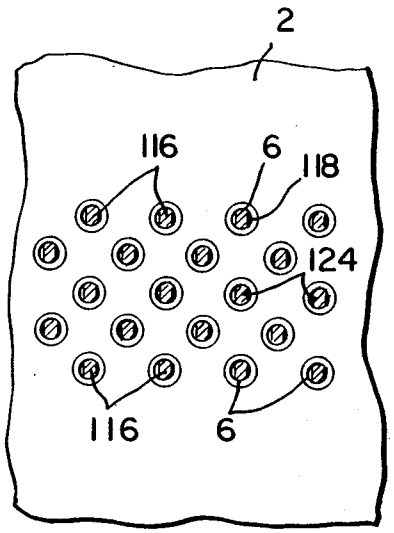
Figure 7:
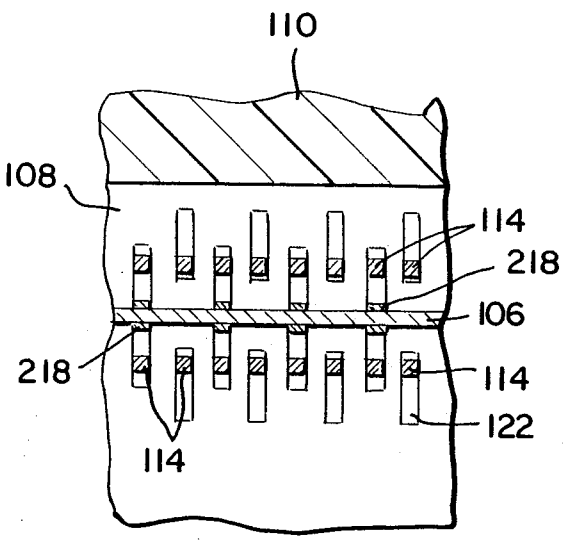
Figure 8:
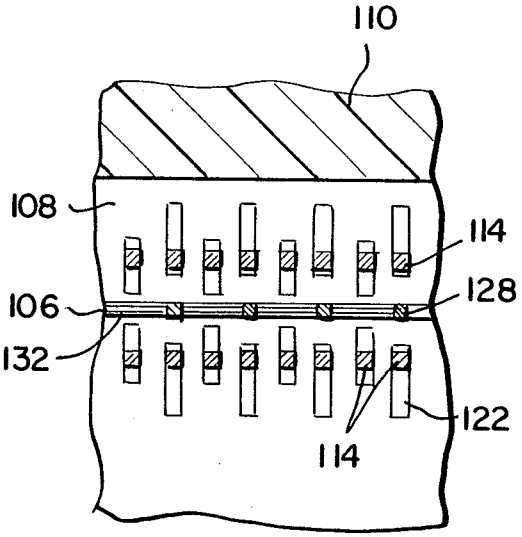
Figure 10:
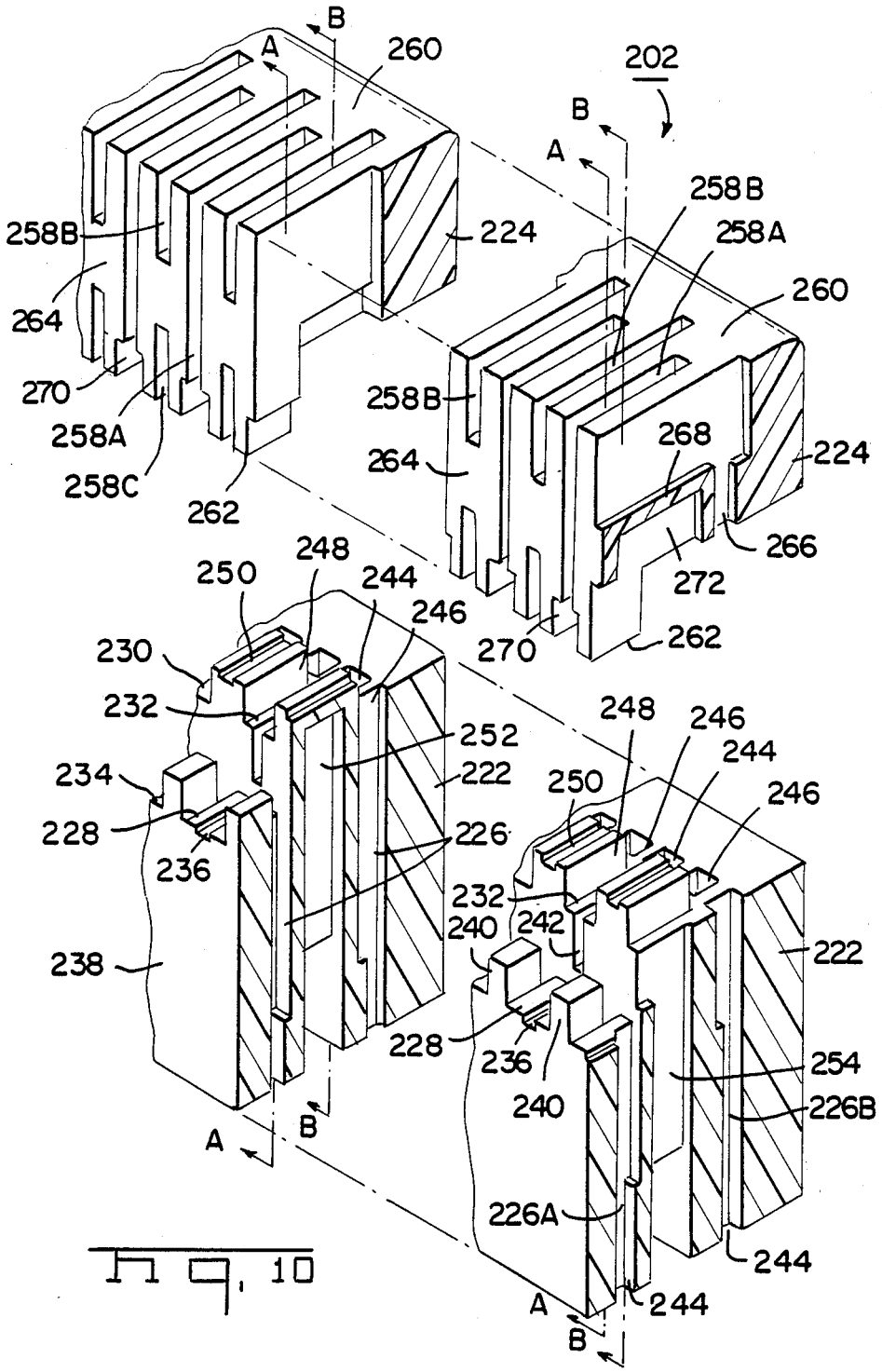
FIG. 10 is an exploded perspective view, partially in section, showing the insulative housing of the daughterboard signal connector.
Figures 11A, 11B:
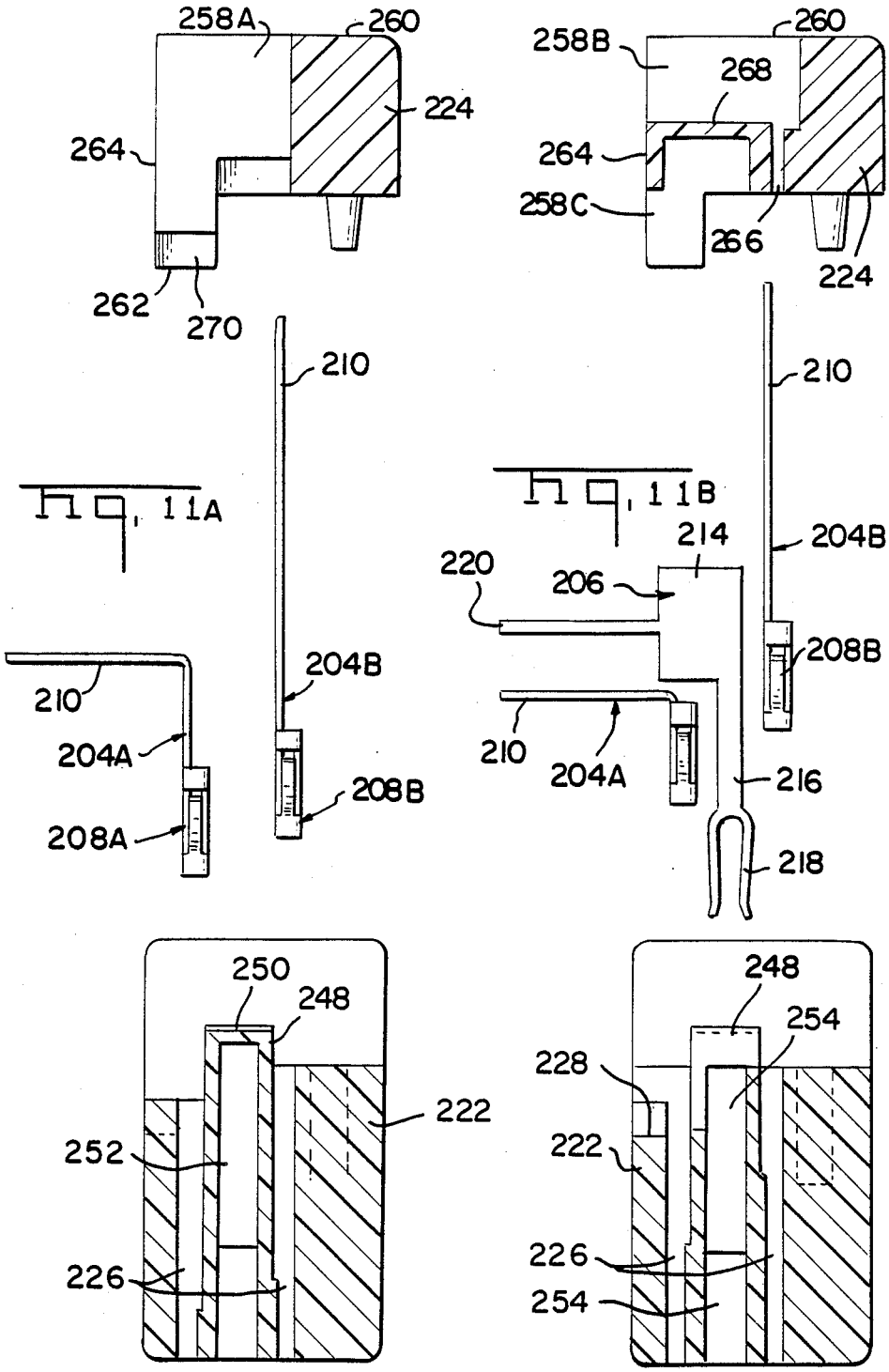
Figure 12B:
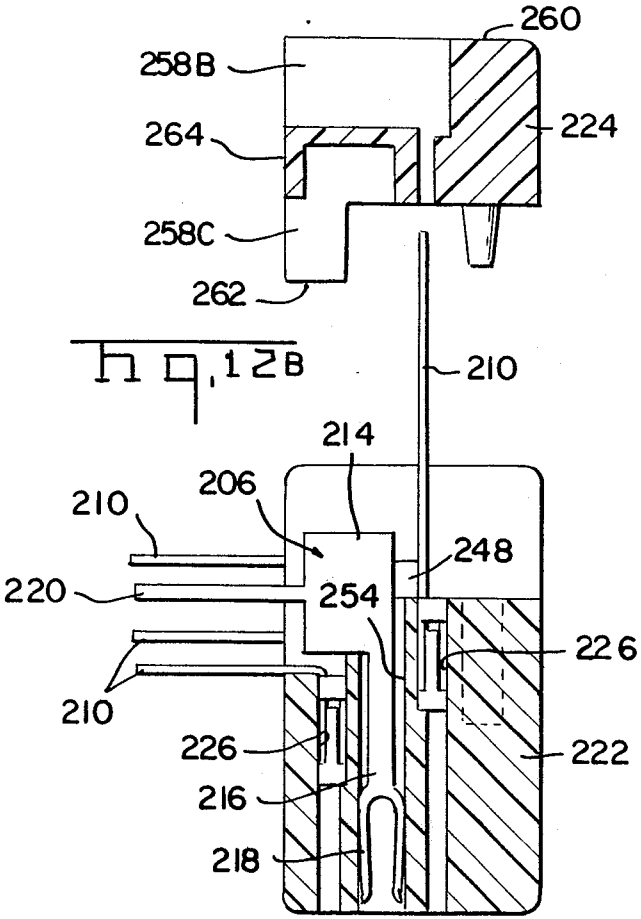
Figure 12A:
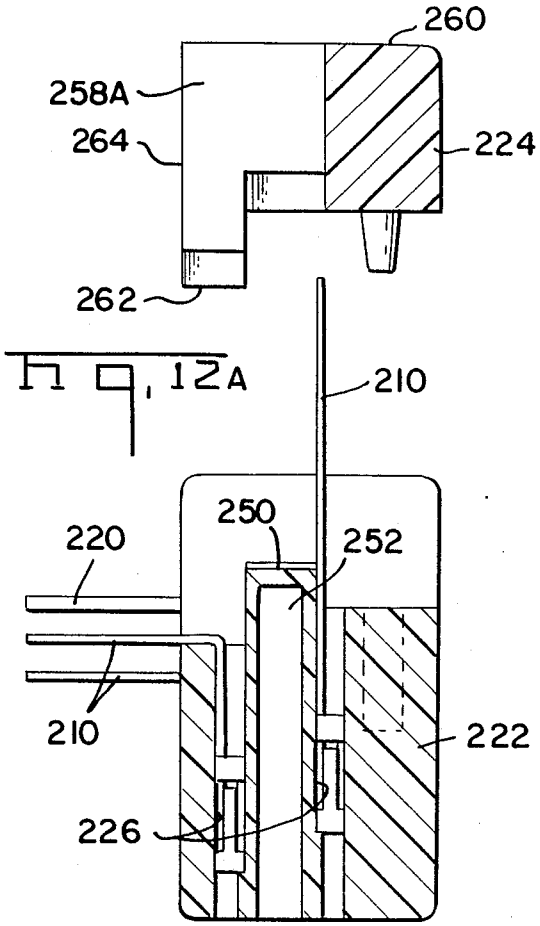
Figure 17A:
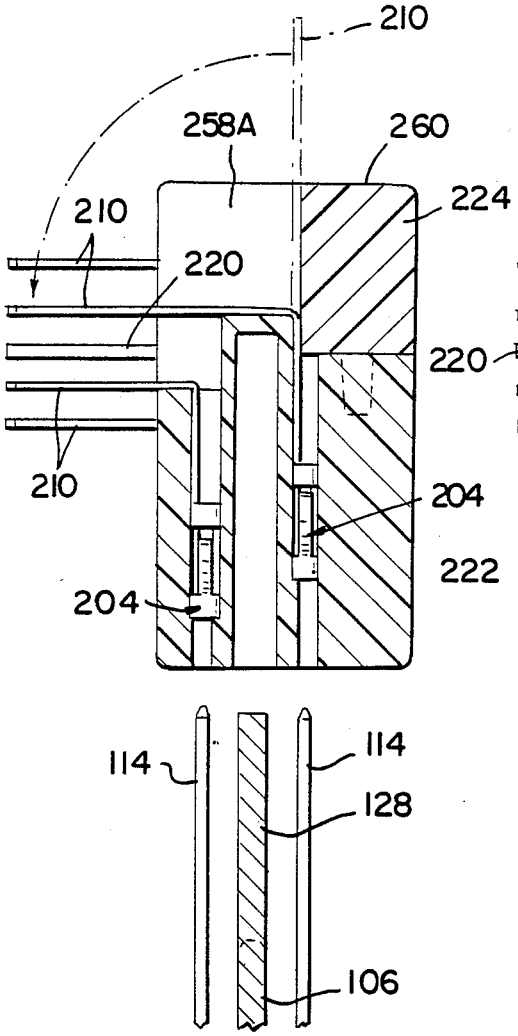
Figure 17B:
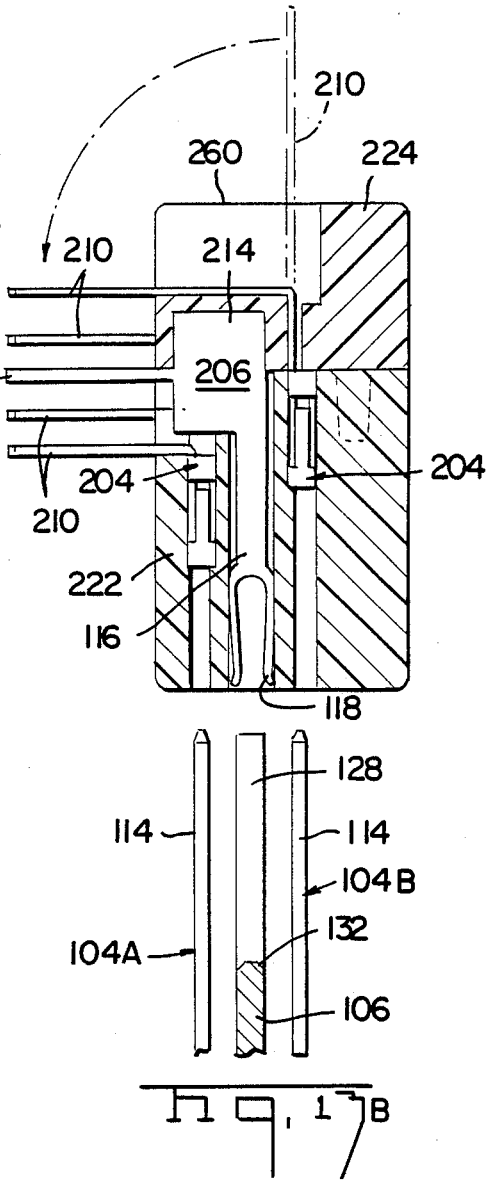

Coaxial Motherboard Signal Input Connector (See FIGS. 1, 4A and 4B)

The coaxial connector 400 employed to interconnect the signal conductors 410 to the motherboard 2 consists of a housing 402 formed of a material such as Ryton. The housing 402 has a plurality of apertures 404. Each aperture 404 receives either a signal receptacle contact 406 or braid contact ground pins 408. The signal receptacle 406 can be interconnected to the center conductor 412 of a conventional coaxial cable 410 by crimping, and the ground pins 408 can be crimped to the outer braid 414 surrounding the center signal conductor 412. The coaxial connector also has a ground plane 420 formed of a conductive material. This ground plane 420 has a plurality of resilient contact apertures 424. These contact apertures 424 are formed by orthogonal slits 426 cut into the conductive plate 420. Since the ground pins 408 attached to the coaxial conductor braids 414 extend upwardly beyond the signal receptacle contacts 406, the ground pins 408 can be inserted into these contact apertures 424 to engage the aperture flaps 428 formed by the orthogonal slits 426. The ground plane 420 also has a plurality of circular holes 422 which are in alignment with the receptacle contacts 406. The receptacle contacts 406 do not, however, extend through the circular openings 422 formed in the ground plane 420. The ground plane 420 is, in turn, embedded within the insulative housing 402 of the coaxial connector 400. The configuration of the circular apertures 422 in the ground plane is arranged to correspond to the configuration of the pins 116 in the motherboard backplane connector 100 and is the same configuration as the openings in the motherboard 2 through which these pins 116 are inserted. The ground plane 420 thus serves to interconnect all of the braids 414 of the individual coaxial conductors 408 to the ground in the motherboard backplane connector 100, without shorting the signal conductors 412 or signal receptacle contacts 406.

Motherboard Backplane Connector (Signal Section)

Figure 2:
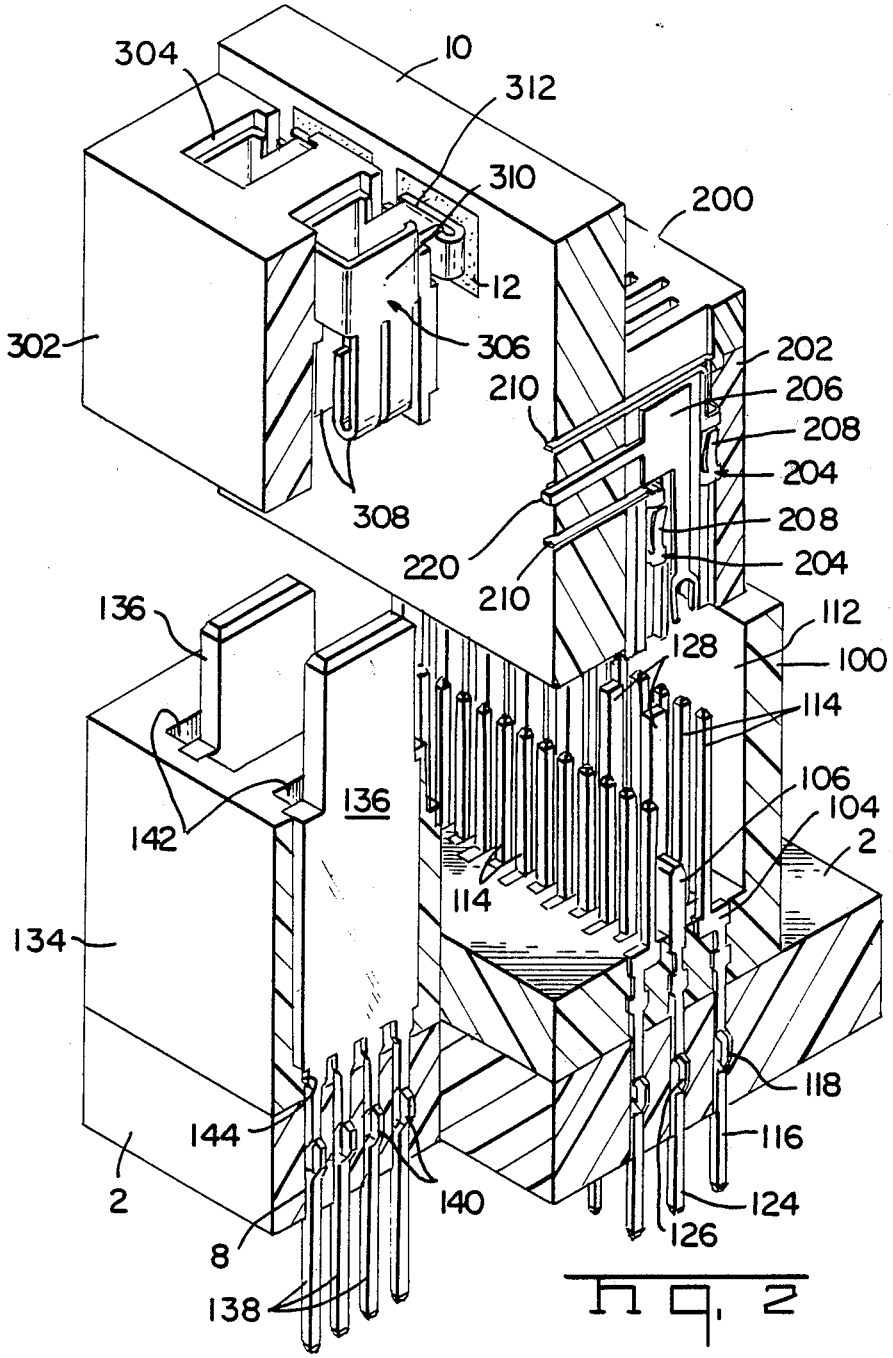
FIG. 2 is an exploded perspective view of the motherboard connector with the daughterboard power and signal connectors positioned for mating.
Figure 7:
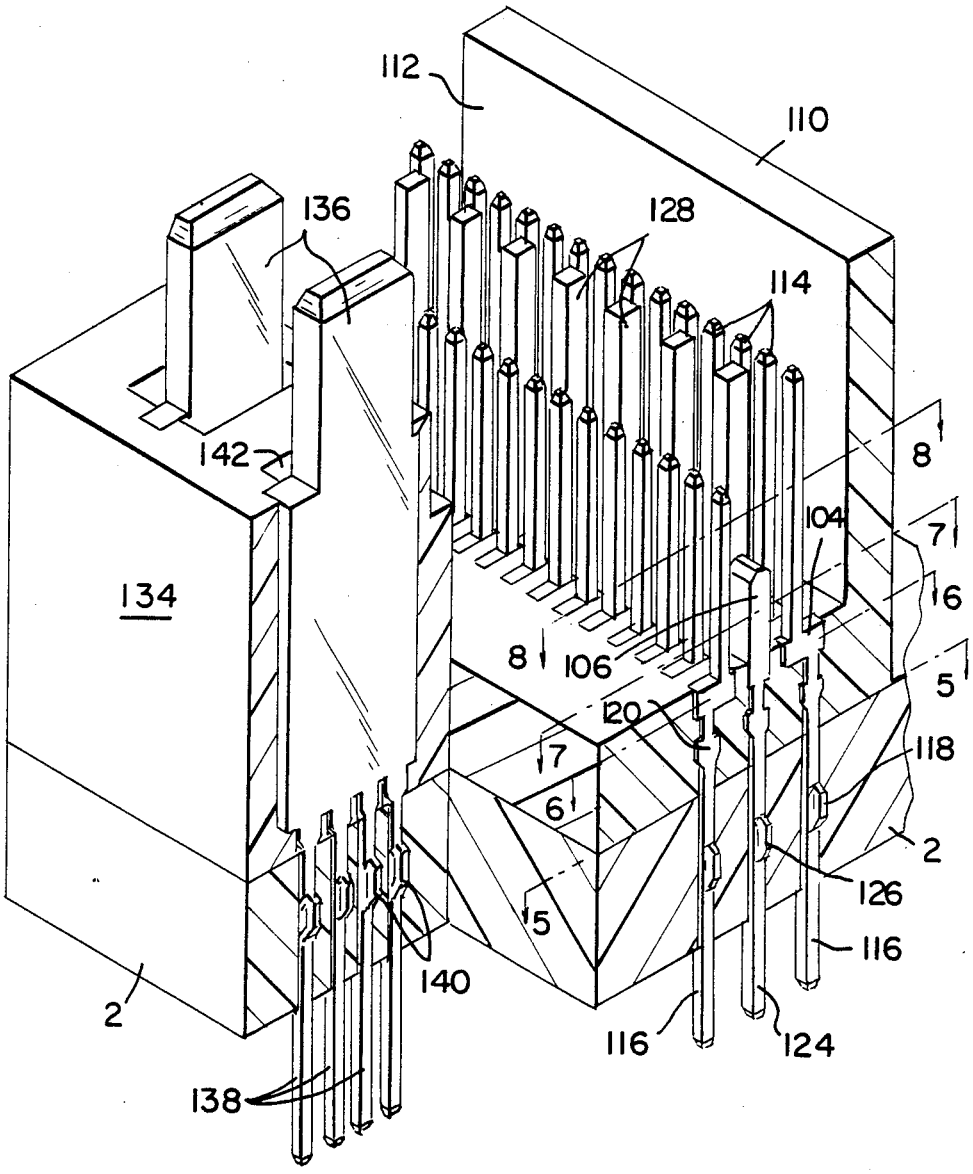
FIGS. 5–8 are section views taken along section lines 5—5, 6—6, 7—7, and 8—8 in FIG. 3, showing the position of the ground and signal contacts in the motherboard backplane connector and the daughterboard signal connector.

(See FIGS. 1-3)

The motherboard backplane connector 100 has a plurality of signal contacts 104 and a ground plane contact or ground bus 106, each mounted in an insulative housing 102 formed from a material such as Ryton. The insulative housing 102 has a base 108 through which both the signal contacts 104 and the ground bus 106 extend and a lateral upwardly extending wall 110 which forms a cavity 112 along the uppwer side of the motherboard backplane connector 100. Each signal contact 104 is in the form of a pin having an upper section 114 and a lower section 116. The lower section 116 of each signal pin 104 includes a spring contact 118 adapted to make interconnection with a plated through hole 4 in the printed circuit motherboard 2. It should be understood, however, that the lower portion 116 of the signal contact 104 can have other configurations, such as a conventional solder pin configuration. The lower portion 116 of each signal pin contact 104 has barbs 120 for securing the signal contact pin 104 in the lower base 108 of the insulative housing 102 of the motherboard backplane connector 100. The lower section 116 of each signal pin contact 104 is offset from the upper pin section 114 by a central dogleg 122, which is located at the top of the base 108. Since the upper pin section 114 and the lower pin section 116 can extend from the dogleg 122 at different points, the signal contact pins 104 can be formed so that the upper sections 114 are in line whereas the lower pin sections 116 are offset or staggered.

Four rows of lower contact pins 116 are formed with the lower pin sections 116 in adjacent rows being mutually spaced apart by a distance of 0.100 inch. Note, however, that the upper contact pin sections 114 are all spaced in a single row with a spacing of 0.050 inch. Thus, the upper contact pin sections 114 can be closely spaced whereas the lower section 116 can be spaced apart by a distance which makes the fabrication of traces on the printed circuit motherboard 2 easier.

The ground bus 106, positioned between inner and outer rows 104A and 104B of signal contact pins 104, also has a plurality of depending legs 124 which are of the type suitable to form a spring contact with plated through holes 6 in a printed circuit motherboard 2. As with the signal contact pins 104, these spring contacts 126 can be replaced by a through hole solder pin configuration. The signal ground bus 106 formed in the motherboard backplane connector 100 extends laterally along the length of the base 108 and extends upwardly into the cavity 112 formed on the upper side of the insulative housing 102. A plurality of posts 128 spaced apart by a distance of 0.100 inch extends upwardly from the upper portion of the ground plane contact or bus 106. The width of these pins is the same as the width of the ground plane bus 106. A beveled section 132 is formed on the upper edge of the bus 106 between adjacent upstanding posts 128. The motherboard backplane connector 100 is configured such that the upper signal contact pins 114 are equally spaced apart from the ground bus 106. The lower signal contact portions 116 are, however, spaced from the ground plane legs 124 by different distances.

Daughterboard Backplane Signal Connector (See FIGS. 1, and 10–13)

The daughterboard backplane signal connector 200 has a insulative housing 202 formed of a material such as Ryton and has a plurality of signal and ground contacts, 204 and 206 respectively, positioned therein. The signal contacts 204 each have a box type receptacle 208 similar to the receptacle 406 employed in the coaxial connector 400. The signal contacts 204 each have signal contact legs 210 extending at right angles with respect to the receptacle contact portion 208. Since the length of the upper portion of the signal pins 114 in the motherboard backplane connector 100 is longer for the rows 104B on the outer portion of the ground plane bus 106 than for rows 104A on the inner side of the ground plane 106, the receptacle contact portions 208 are not located at the same height. The legs 210 extending from the receptacle portions of the daughterboard signal contacts are staggered in a similar configuration to the lower signal sections 116 of contacts 104 which establish interconnection to the traces on the motherboard 2.

Instead of a single continuous ground plane in the daughterboard signal connector 200, a plurality of ground blades 206 are located between the signal legs 210 having the greatest spacing. Each blade 206 and corresponding receptacle 208 has a central section 214 with a lower vertically extending segment or arm 216 which extends between the receptacle portions **208*b* of the signal contacts in the outermost rows. This vertically extending arm of the blade has a bifurcated spring contact 218, located at its lower end, suitable for establishing a resilient contact with the base of the ground plane bus 106 in the motherboard connector 100. The central section 214 of each blade 206 extends above the innermost receptacles 208*a* and includes a horizontal arm segment 220 extending adjacent to the right angle portion of the leg 210 of the outermost receptacle contact 208*b*. These ground blades 206 are located only between the daughterboard signal contacts 208*b* having legs spaced apart by a distance greater than the contacts relatively more closely spaced apart. Note that the leg 216 of each ground blade 206 is surrounded by six equally spaced signal contact legs 210 which are arranged in a hexagonal configuration surrounding each ground blade leg 216. Each ground blade 206, when mated with the ground plane 106 of the motherboard connector 100, extends between adjacent upwardly extending posts 128. Note that the ground blade configuration and the ground post configuration forms a spacing between signal contacts 204 and the ground such that a constant impedance is maintained for the signals transmitted including the motherboard backplane connector 100 and the daughterboard signal connector 200** through the backplane connector assembly.

The daughterboard signal housing 202 comprises a multi-part insulated member consisting of a base 222 and at least one cap member 224. In the preferred embodiment of this invention, a single base member 222 is employed and a plurality of side-by-side cap members 224 are securable to the single base member. The base member 222 has two rows of cavities 226 for receiving a signal contact. Cavities in each row are spaced apart by a nominal spacing. In the preferred embodiment of this invention, this spacing is 0.050 inch between the centerline of adjacent cavities 226. The upper portion of each of these cavities is dimensioned to receive the receptacle portion 208 of each signal contact 204.

The upper surface of the insulative base member 222 has a step configuration with one tier of signal receptacle cavities 226A being located along a lower step 228 and the other tier of cavities 226B extending inward into the upper surface 232 of the upper step 230. The lower step 228 of the base member 222 has a groove 236 extending to the front face 238 and communicating with cavities 226A in alternate rows 244 extending through the upper face 234 of the lower step 228. A support pedestal 240 is located between the cavities 226A in alternate rows 244 and the front face 238 of the base 222.

On the upper step 230, a groove 242 communicating with other cavities 226B, in alternative rows 246, from the upper surface to the lower surface of the base 222 is located adjacent cavities in rows 244 and extends to the edge of the upper step 230. Between grooves 242, and adjacent other alternate cavities 246 extending into the upper step 230, are crowns 248 which extend upwardly from the upper surface 232 of the upper step 230. Each of these crowns 248 has a crown groove 250 extending along its top from the corresponding cavity to the front of the upper step 230. A plurality of slots 252 extend from the lower surface of the base 222 in alignment with the crowns 248 located along the upper step 230. These slots 252, aligned with the crowns 248, are adjacent to other slots 254 which extend from the adjacent or alternating grooves 242 in the upper step through to the lower surface of the base 222.

Signal contacts 204 are loaded from the upper surface of the base 222 into each of the aligned signal cavities 226. The contact leg 210 of each signal contact 204 in the row of signal cavities along the lower step 228 are then folded over the pedestals 240 or between adjacent pedestals.

Ground blades 206 are simularly inserted from the upper surface of the base 222 into the slots 254 communicating through the base 222. The lower segment 216 of each of the ground blades 206 is inserted into the corresponding slot 254, and the central segment 214 and the upper segment 220 extend above the upper step 230 of the base 222. Rear signal contacts 204, longer than the front signal contacts 204, are inserted into the appropriate signal cavities 226 in the upper step 230 through the upper surface 232 thereof. The legs 210 from these rear signal contacts 204, aligned with the crowns 248, are then bent over into the crown grooves 250 formed along the upper surface of the crowns 248, such that the legs 210 of these alternate rear signal contacts 204 extend generally parallel to the legs in the front signal contacts 204 previously inserted into the base.

After the signal contacts 204 have been inserted into the insulative base 222, one or more cap members 224 is then attached to the upper surface of the insulative base 222. In the preferred embodiment of this invention, a plurality of cap members 224 are employed, thus providing access to the individual contacts for repairability. Each cap member 224 has a plurality of recesses 258 communicating with the front of the cap member 224. Alternate recesses **258*a* extend completely through the cap member 224 from the top surface 260 to the bottom surface 262 and communicate with the front surface 264. Adjacent to these first mentioned recesses 258*a* are a pair of recesses 258*b* and 258*c*, one of which 258*b* communicates with the upper surface 260 from the front face 264 rearwardly, where a channel 266 is formed from the recess 258***b* down to the bottom face 262 of the cap 224. The other of these pairs of recesses 258*c* extends inwardly from the front 264 and is separated from the upper face of the cap by an internal rib 268. Note that the contour of the internal rib 268 is complementary with the top of the ground blade 206. The recesses 258*a* and 258*b* which communicate between the top surface 260 and bottom surface 262 along the entire length of the front face 264 have a widened step 270 of their lower edge. When the cap 224 is installed on the base 222, this widened step 270 fits over the pedestals 240 on the upper surface 234 on the lower step 228 of the base 222, thus trapping a bent lead between the pedestal 240 and the recess 258*c*. The upper leads 210 of the rear contacts 204*b* initially extend straight up from the receptacle 208B. However, the upper portion of the recess 258*b* is open, thus permitting the straight lead 210 to be bent down by a tool insertable into the upper recess 258*b* so that the lead will then be bent at right angles, parallel to the other leads 210 extending to the daughterboard 10. The top portion of the ground blade 206 fits within a complementary recess 272 formed below the internal ribs 268, with the daughterboard ground blade lead 220 extending outwardly from the front face 264 of the cap 224. In this manner, the daughterboard signal contacts 204, the daughterboard ground blade 206 and the daughterboard housing 202 can be assembled. Note that the slots 252 extending upwardly from the lower surface of the insulative base, adjacent the ground blade slots 252 extending completely through the insulative base and aligned with the upper crowns 248, are dimensioned to receive the upstanding posts 128 on the ground plane bus 106 to form a comb in the signal portion of the motherboard backplane connector 100.

Motherboard Backplane Connector (Power Section)

(See FIGS. 1–3)

In the preferred embodiment of this invention, the motherboard backplane connector 100 includes a power section integral with the motherboard signal connector section. The motherboard backplane insulative housing 100, in addition to containing apertures for receiving the signal pins 104 and the ground bus pins 124, includes a power section 134 containing a plurality of pockets 142 for receiving male power blades 136 and apertures 144 for receiving through hole legs 138. A plurality of through hole legs 138 extend from each power blade 136 which is located in a pocket 142 on the top of the power section 134 of the insulative housing. The plurality of legs 138 provide ample cross-sectional area for conducting power from the power traces in the motherboard 2 up through the single blade which is located at a right angle relative to the daughterboard 10. Each leg 138 has a resilient integral spring section 140 for contacting the plated through holes 8 in the motherboard 2.

Daughterboard Power Connector (See FIGS. 1 and 2)

The daughterboard power connector 300 is completely separate from the daughterboard signal connector 200. The daughterboard power connector 300 includes a housing 302 containing a plurality of side-by-side cavities 304, each of which receives a single daughterboard power contact 306 which is surface mounted to power traces in the daughterboard 10 through surface mount pads 12. The individual power contacts 306 in the daughterboard power connector 300 each have dual U-shaped contact legs 308 extending downwardly and located at right angles relative to the daughterboard 10. Each U-shaped leg 308 is resilient and is adapted toreceive a single blade delivering power from the motherboard 2. Note that the width of the motherboard power blades is such that contact can still be established even though the motherboard power blades are mated at different lateral positions relative to the female daughterboard power contacts 306. Thus, the power configuration is not dependent upon the useof a daughterboard 10 having a specified thickness. The resilient spring legs 308 in the daughterboard receptacle contacts 306 project downwardly from a box section 310 in the stamped and formed power contact 306. A surface mount foot 312 having a reversely bent configuration extends orthogonally relative to the box section 310 to establish contact with a surface mount power pad 12.

We claim:

1. An electrical connector assembly for use in impedance controlled interconnections between a motherboard and daughterboard, the assembly comprising:

a first connector containing a plurality of first signal contacts;

a second connector containing a like plurality of mating second signal contacts, the first and second connectors and the first and second signal contacts being configured to form a right angle interconnection of the motherboard and daughterboard; and ground means including a planar ground bus in the first connector extending between rows of first signal contacts and a plurality of separate ground contacts in the second connector, extending between second signal contacts, each ground contact comprising a planar member with a resilient contact section and means for interconnection to a printed circuit board, the ground contacts being disposed in spaced parallel relationship, the planar members, between the resilient contact section and the means for interconnection to a printed circuit board extending at right angles to the planar ground bus in the first connector.

2. The connector assembly of claim 1 wherein the planar ground bus includes a plurality of separate spaced posts extending upwardly from a planar base.

3. The connector assembly of claim 2 wherein the ground contacts are disposed between adjacent posts when the connectors are mated.

4. The connector of claim 3 wherein each ground contact has a vertically extending segment positioned between adjacent posts and a laterally extending segment protruding laterally beyond the posts.

5. The connector assembly of claim 4 wherein each ground contact includes a resilient contact section on one end of the vertically extending segment the resilient contact section being engageable with the planar base.

6. The connector assembly of claim 5 wherein the laterally extending segment comprises means for forming an interconnection with the daughterboard.

7. The connector assembly of claim 1 wherein each ground contact comprises a flat blade having a central segment with first and second segments extending mutually orthogonally from adjacent sides of the central segment.

8. The connector assembly of claim 7 wherein the central segment has a flat rectangular configuration.

9. The connector assembly of claim 8 wherein each of the first and second segments are narrower than the central segment.

10. The connector assembly of claim 7 wherein the first segment has a resilient contact portion on a free end.

11. The connector assembly of claim 10 wherein the second segment comprises means insertable into a plated through hole in a printed circuit board.

12. The connector assembly of claim 8 wherein the first segment extends from an edge of one side of the flat rectangular central segment.

13. The connector assembly of claim 12 wherein the second segment extends from a point intermediate the edges of a side of the flat rectangular central segment other than the side from which the first segment extends.

14. The connector assembly of claim 8 wherein the first segment extends from a first side of the flat rectangular central segment and the second segment extends form a second side of the flat rectangular central segment, one second signal contact being positioned adjacent each ground contact in a quadrant between the mutually orthogonal first and second segments.

15. The connector assembly of claim 14 wherein another second signal contact is positioned adjacent a third and fourth side of each flat rectangular central segment, the other second signal contact being longer than the one second signal contact.

16. The connector assembly of claim 15 wherein at least one additional second signal contact is located adjacent opposite faces of each flat rectangular central segment.

17. The connector assembly of claim 1 wherein at least one second signal contact is located adjacent opposite faces of each planar ground contact.

18. The connector assembly of claim 1 wherein at least one second signal contact is located between adjacent planar ground contacts.

19. The connector assembly of claim 1 wherein each first signal contact comprises a signal pin, the signal pin having an upper section offset from a lower section by a dogleg section intermediate the ends thereof.

20. The connector assembly of claim 19 wherein the spacing between the upper sections of adjacent signal pins differs from the spacing between lower sections of the same signal pins.

21. An electrical connector assembly for use in interconnecting electrical paths on two printed circuit boards, the assembly comprising:

a first connector containing a plurality of first signal contacts;

a second connector containing a like plurality of mating second signal contacts; and ground means including a planar ground bus in the first connector extending between rows of first signal contacts and a plurality of separate ground contacts in the second connector extending between second signal contacts, each ground contact comprising a planar member, the ground contacts being disposed in spaced parallel relationship, the planes of the ground contacts extending at right angles to the planar ground bus in the first connector.

22. The connector assembly of claim 21 wherein the planar ground bus includes a plurality of separate posts extending upwardly from a planar base.

23. The connector assembly of claim 21 wherein each separate post is located in a plane between and parallel to the planes of adjacent ground contacts.

24. The connector assembly of claim 23 wherein each ground contact includes a resilient contact portion engageable with the planar base of the planar ground bus between adjacent posts when the connectors are mated.

25. The connector assembly of claim 24 wherein second signal contacts are positioned adjacent inner and outer edges of each ground contact.

26. The connector assembly of claim 25 wherein additional signal contacts are positioned between adjacent signal contacts.

27. The connector assembly of claim 26 wherein each first signal contact comprises a pin and each second signal contact includes a receptacle matable with a first signal contact pin.

28. The connector assembly of claim 27 wherein the first signal contacts are positioned in rows on opposite sides of the ground bus, the first signal contacts on one side of the ground bus being shorter that the first signal contact on the other side of the ground bus.

29. The connector assembly of claim 21 wherein each first signal contact comprises a signal pin, the signal pin having an upper section offset from a lower section by a dogleg section intermediate the ends thereof.

30. The connector assembly of claim 29 wherein the spacing between the upper sections of adjacent signal pins differs from the spacing between lower sections of the same signal pins.

31. An electrical connector assembly for use in interconnecting electrical paths on two printed circuit boards, the assembly comprising:

a first connector containing a plurality of first signal contacts in a first insulative housing;

a second connector containing a like plurality of mating second signal contacts in a second insulative housing; and a plurality of separate ground contacts in the second connector, each ground contact comprising a planar member having flat sides and inner and outer edges, the ground contacts being disposed in spaced parallel relationship, some of the second signal contact being positioned adjacent the inner and outer edges of each planar ground contact and other signal contacts being disposed between adjacent sides of adjacent planar ground contacts.

32. The connector assembly of claim 31 wherein the first insulative housing includes a cavity, the first signal contacts extending into the cavity, and the second insulative housing is insertable into the cavity.

33. The connector assembly of claim 32 wherein the second insulative housing comprises a base member and at least one cap member securable to the top of the base, the second signal contacts and the ground contacts being insertable into the base through the top before the cap is secured to the base, the base including a plurality of receptacle cavities, each second signal contact comprising a receptacle contact having a receptacle insertable into a corresponding receptacle cavity, each receptacle contact including an upper leg extending at right angles to the corresponding receptacle and parallel to the top of the base member.

34. The connector assembly of claim 33 wherein the receptacle contacts are positioned in a front row and a rear row, the receptacle contacts in the rear row being longer than the receptacle contacts in the front row, the top of the insulative base being formed by a front step and a rear step, the receptacle contacts in the front row extending through the front step and the receptacle contacts in the rear row extending through the rear step.

35. The connector assembly of clam 34 wherein the receptacles in the receptacle contacts in the rear row are upwardly offset from the receptacles in the receptacle contacts in the front row.

36. The connector assembly of claim 35 wherein the upper legs of receptacle contacts in each row are vertically offset from the upper legs of adjacent receptacle contacts in the same row.

37. The connector assembly of claim 36 wherein the insulative base includes grooves extending between alternate aligned pairs of receptacle contacts in the front row and the rear row, each groove extending between the top and the bottom of the insulative base, a portion of each ground contact being positioned within a groove.

38. The connector assembly of claim 37 wherein a cap member includes a plurality of first recesses and openings on a lower surface, each ground contact being recessed in a corresponding first recess when corresponding first recesses and grooves are aligned.

39. The connector assembly of claim 38 wherein the upper legs of receptacle contacts extending along an outer edge of a ground contact extend upwardly through a channel in the same plane as the first recess receiving the correspond ground contact, the latter upper leg being bent at right angles and extending along the top of an internal rib extending above each first recess in the cap member.

40. The connector assembly of claim 38 wherein second recesses extend between pairs of first recesses, the second recesses extending between the upper and lower surfaces of the cap member.

41. The connector assembly of claim 40 wherein a plurality of slots extend from the bottom of the insulative base, each slot extending parallel to and between a pair of grooves, the ground post extending upwardly into the cavity in the first insulative housing being received within each slot.

* * * * *

UNITED STATES PATENT OFFICE

CERTIFICATE OF CORRECTION

Patent No. 4,917,616 Dated April 17, 1990

Inventor(s) Henry W. Demler, Jr., Frank P. Dola, David J. Kimmel, Thomas J. Sotolongo It is certified that error appears in the above-identified patent and that said Letters Patent is hereby corrected as shown below:

In claim 31, column 10, line 44, the word "contact" should be --contacts--.

In the Abstract in line 8, after the word "power" insert the word --connector--.

Signed and Sealed this

First Day of October, 1991

*Attest:*

HARRY F. MANBECK, JR.

*Attesting Officer*

*Commissioner of Patents and Trademarks*